US005590961A

United States Patent [19]

Rasmussen

[11] Patent Number: 5,590,961

[45] Date of Patent: Jan. 7, 1997

[54] METHOD FOR INJECTING A FIRST FLUID INTO A SECOND FLUID AND AN APPARATUS FOR CARRYING OUT THE METHOD

[75] Inventor: Carsten O. Rasmussen, Glostrup, Denmark

[73] Assignee: Niro Holding A/S, Soborg, Denmark

[21] Appl. No.: 403,816

[22] PCT Filed: Dec. 15, 1993

[86] PCT No.: PCT/DK93/00421

§ 371 Date: Mar. 14, 1995

§ 102(e) Date: Mar. 14, 1995

[87] PCT Pub. No.: WO94/13395

PCT Pub. Date: Jun. 23, 1994

[30] Foreign Application Priority Data

Dec. 16, 1992 [DK] Denmark ..... 1506/92

[51] Int. Cl.[6] ..... B01F 7/16

[52] U.S. Cl. ..... 366/165.1; 366/181.4; 366/317; 366/304

[58] Field of Search ..... 366/302, 303, 366/304, 165.1, 165.2, 181.4, 182.2, 317, 315, 316, 157.1, 158.1, 150.1

[56] References Cited

U.S. PATENT DOCUMENTS 1,711,154 4/1929 Michal ..... 366/303
3,744,763 7/1973 Schnoring ..... 366/303
3,998,433 12/1976 Iwako ..... 366/304
4,332,486 6/1982 Mutalibov ..... 366/304

FOREIGN PATENT DOCUMENTS

3127684C2 2/1983 Germany .
3417242A1 11/1985 Germany .

*Primary Examiner*—Robert W. Jenkins
*Attorney, Agent, or Firm*—Sughrue, Mion, Zinn, Macpeak & Seas

[57] ABSTRACT

In injection of steam, gas or liquid into a fluid product in an injection apparatus having a substantially disc-shaped rotor (5) and having a central product inlet (10) and a peripheral product outlet (11), the injection is carried out in a limited zone (13) above the disc-shaped rotor (5) at a distance from both said inlet (10) and said outlet (11), the fluid product being also exposed to a radial displacement effect and a tangential dispersion effect. The fluid product may be a liquid with considerable variation of dry solids content and viscosity. The injection apparatus comprises at least one cylindrical wall (7, 8) projecting upwards from the disc-shaped rotor (5), which wall projects between coaxial cylindrical walls (14, 15) projecting downwards from an overlying stator cover (9). The coaxial cylindrical walls (7, 8, 14, 15) on the rotor (5) and the stator cover (9) are formed with substantially axis-parallel sharp-edged slots (19), and feed passages (16) are connected to the stator cover (9) for injection into a space (13) positioned between the coaxial cylindrical walls (14, 15) on the stator cover (9) and constituting an injection chamber.

14 Claims, 1 Drawing Sheet

Figure 1:
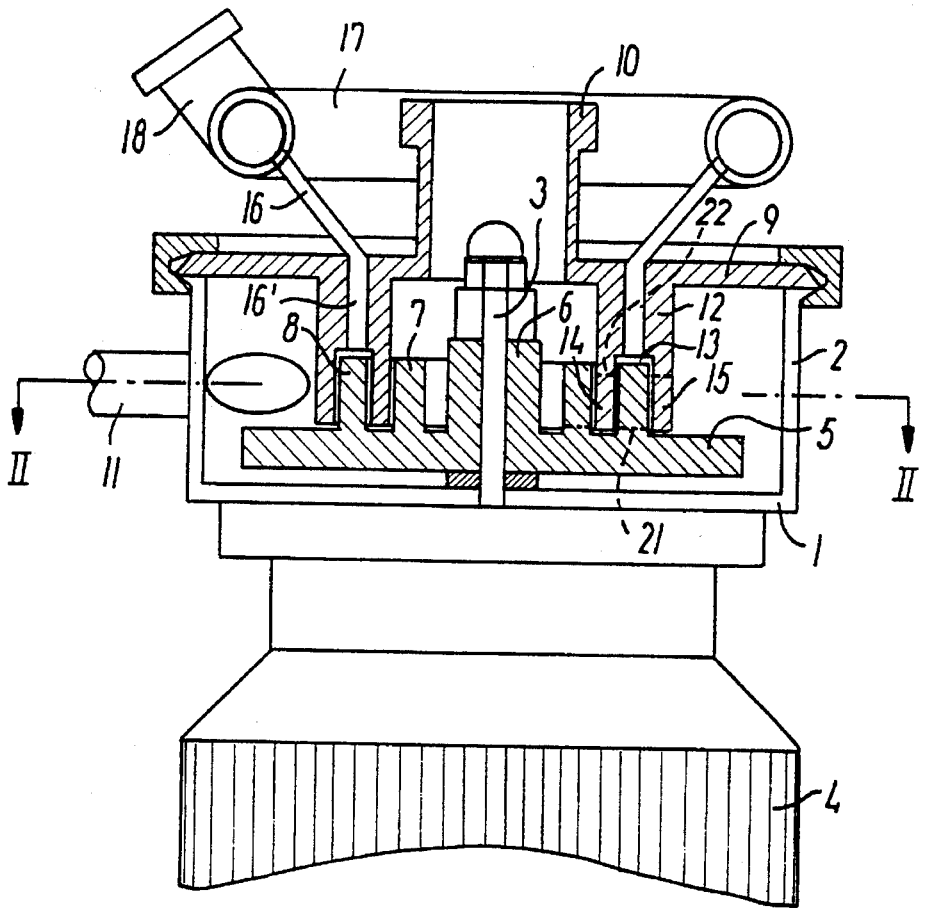

METHOD FOR INJECTING A FIRST FLUID INTO A SECOND FLUID AND AN APPARATUS FOR CARRYING OUT THE METHOD

The invention relates to a method of injecting a first fluid into a second fluid, whereby in an injection apparatus having a substantially disc-shaped rotor, a radial displacement effect is imparted to the second fluid from a central product inlet to a peripheral product outlet, said first fluid being injected into an annular injection chamber above the disc-shaped rotor displaced form both said inlet and said outlet, in which chamber the second fluid is exposed to a tangential dispersion effect in addition to said displacement effect.

Without in any manner being restricted thereto, the method according to the invention has substantial fields of application in, partly, heat treatment of liquids by injection of steam, for example bactericidal UHT treatment of milk products or pregelatinization of starch products, partly injection of gases, for example $CO_2$ or nitrogen into such liquids which are subsequently to be spray dried with the aim of reducing the density of a powder product obtained by the spray drying, partly injection of a liquid, for example water, into certain fatty or oily products with a view to reduction of the fat content.

In connection with the spray drying of food products, for example milk products or fruit juice, it is known from U.S. Pat. Nos. 3,185,580 and 3,222,193 to make an injection of a gas directly into an elongated mixing pipe through which the liquid starting material flows before supply to an atomizer in the spray drying apparatus. This type of gas injection is not suitable for heat treatment at higher temperatures, as it will inevitably lead to burning. Actually, the above patents also direct that a heat treatment of the product, for example for pasteurization purposes, be made in a conventional preheater.

U.S. Pat. No. 3,182,975 describes an apparatus for heat treatment of milk products at an increased temperature after a prior preheating by injection of steam into a mixing chamber to which the product to be treated is supplied. Steam injection is carried out by means of a propeller-like rotor with perforated tubular blades where the steam extravasates on the back of the rotor blades seen in the direction of rotation at a relatively low pressure, whereby the pressure is increased through the mechanical influence from the rotation of the rotor. The intention is to obtain a rapid heating without burning.

SU patent specification No. 578046 describes another method of heat treatment of milk products where the product is also supplied to a mixing chamber by a propeller-like rotor, but here the steam supply is made via a distributor system with annular distributing conduits arranged concentrically in relation to the rotor and controlled by means of a valve arrangement so that the steam in the central area of the chamber is supplied at a relatively low temperature and pressure, and in the peripheral area at a substantially increased temperature and pressure. The intention is to obtain a very rapid heating to sterilization level after a preheating in the central area. In this construction, however, the strong heat influence at the periphery involves a considerable risk of burning.

It is known from U.S. patent specification No. 4,479,908 to make an injection of gas into a fluid product of a higher density by a method in which a strong turbulence and high flow velocity are imparted to the fluid product by passing it through a conduit part with a curved wall in connection with a constricted flow section where the gas injection takes place through an adjustable nozzle. According to the patent, the method may also be used for heat treatment of milk products by injection of steam at a temperature of about 170° C.

CH patent specification No. 531363 describes an apparatus for mixing a liquid raw material with a gas, for example with a view to foaming, whereby the mixing takes place in a mixing chamber by means of a rotor disc with projecting teeth moving between stationary teeth in a surrounding stator part, the rotor disc performing an eccentric circulatory movement about the axis of the stator frame.

Similar embodiments of mixing heads with a rotor provided with teeth engaging with teeth in a stator system where the sets of teeth may be arranged in several steps mutually displaced in the radial and axial directions are known from DE patent No. 3127684, EP patent application No. 0253139 and published international patent application No. WO 91/07221.

Whereas, in the two latter mixing methods the supply of the fluid product to be treated, and the injection of gas take place at the same place in the mixing chamber, preferably in its central part, the method disclosed in DE-C-3127684 provides for injection of the gas into a working space displaced from the inlet and outlet and delimited by projecting toothed rims from the rotor and stator, respectively.

The method of the invention is distinguished from this prior art in that the second fluid is forced through sharp-edged slots extending substantially parallel to the rotor axis in opposed coaxial cylindrical wall parts of the rotor and a stator positioned opposite the rotor.

By forcing the second fluid through said sharp edged slots it has proved possible to optimize the injection for a large number of different applications, and at the same time avoid deposits.

Thus, in connection with heat treatment of food-stuffs and other products, for example the above UHT treatment of milk products, where heating to a temperature of about 120°–150° C. is required in order to obtain the desired bactericidal effect, the method according to the invention thus, in comparison with prior art, causes an almost instantaneous heating as a result of the simultaneous dispersion and displacement which causes an optimum distribution of the injected fluid.

As a result of this, for example, UHT treatment of milk products may be carried out with a higher degree of retention of the original taste and nutritional qualities than possible so far, and without any form of burning.

In a preferred embodiment of the method, said displacement and dispersion effects occur by the second fluid being forced through slots in circumferential wall parts of the rotor and stationary wall parts of an oppositely positioned stator.

The second fluid which is treated by means of the method according to the invention will preferably be a liquid, which may, however, exhibit considerable variation with regard to viscosity and dry solids content, ranging from a mobile liquid without any solids to a viscous paste-like consistency with a dry solids content of up to 90 per cent.

The invention also relates to an apparatus for carrying out the method as defined in the foregoing, said apparatus comprising a substantially disc-shaped rotor positioned parallel to and coaxial with stator in a casing and having a central inlet for said second fluid and a peripheral product outlet, the rotor being provided on the side facing the stator with at least one projecting cylindrical wall and the stator being provided on the side facing the rotor with at least two projecting coaxial cylindrical walls disposed on either side of the cylindrical wall on the rotor.

The apparatus according to the invention is characterized in that sharp-edged slots are formed to the extend substantially parallel to the axis of the rotor in the coaxial cylindrical walls on the rotor and the stator, and that feed passages are formed in the stator for injection of said first fluid into an injection chamber positioned between the coaxial cylindrical walls of the stator.

To obtain a good distribution of the second fluid during its introduction in the injection chamber the rotor suitably has two coaxial cylindrical walls projecting upwards, of which the radially innermost wall will be located radially inside the radially innermost wall of the stator.

In a preferred embodiment of the apparatus the sharp-edged design of the slots in the cylindrical walls, which is important to an efficient dispersion effect, is obtained by the axis-parallel slots in the cylindrical walls being formed as axially directed bores from the free edges of these walls and having a diameter exceeding the wall thickness.

As a substantial additional advantage it has proved possible to design the apparatus in an embodiment which is substantially more silent at steam injection into a liquid than the prior art apparatuses, in that the axis-parallel slots in the cylindrical walls are asymmetrically distributed in the circumferential direction.

Figure 2:
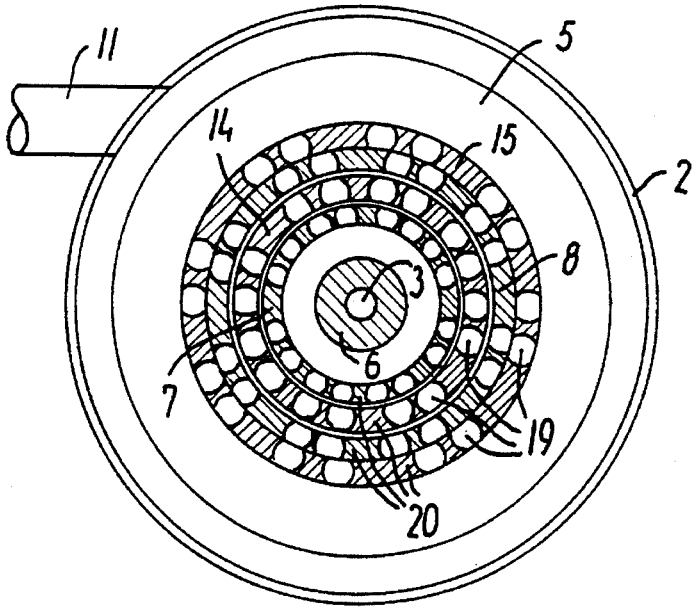

The invention will now be described in further detail below with reference to an embodiment shown in the drawing and by means of examples. In the drawing, FIG. 1 shows an axial cross-sectional view of a preferred embodiment of an apparatus according to the invention; and FIG. 2 is a section along the line II—II in FIG. 1.

In the embodiment shown, the apparatus according to the invention comprises a relatively flat cylindrical casing having a bottom 1 and a side wall 2. A rotor disc 5 is fastened on a drive shaft 3 projecting through the bottom 1 and being connected with a driving engine 4 arranged below the casing, which rotor disc 5 has two concentric walls 7 and 8 arranged radially displaced from the hub bush 6 arranged on the drive shaft 3.

The casing 1 is closed upwards by a stator cover 9 having a central inlet pipe 10 for the second fluid to be treated in the apparatus. Correspondingly, an outlet pipe 11 is connected with the side wall 2 of the rotor casing for discharge of the treated product.

Corresponding to the cylindrical walls 7 and 8 projecting upwards from the upper side of the rotor disc 5, the lower side of the stator cover 9 facing the rotor disc is formed with a tube 12 projecting downwards, at the lower end of which an annular chamber 13 is formed and is delimited by two coaxial cylinder walls 14 and 15. The tube structure 12 is arranged on the lower side of the stator cover 9 so that the walls 14 and 15 are positioned on either side of the radially outermost wall 8 projecting upwards on the rotor disc 5, when the stator cover 9 is arranged on the casing 1. The coaxial cylinder walls 7, 8, and 14, 15 on the rotor disc 5 and the stator cover 9, respectively, are designed with such wall thicknesses and positions that they engage with each other with relatively little clearance.

A number of tubular channels 16 are connected with the annular injection chamber 13 through bores 16' in the tube structure 12, and with an annular distributor pipe 17, to which a feed pipe 18 is connected for the first fluid to be injected into the apparatus.

As best appears from FIG. 2, each of the cylindrical walls 7, 8 and 14, 15 on the rotor disc 5 and the stator cover 9, respectively, are divided into tooth-like wall segments 20 by a number of slots 19. In the embodiment shown, each of the walls thus has a total of sixteen such slots, but this number may be varied within wide limits.

To obtain a very sharp-edged form of the individual slots 19 both at the inner side and the outer side of each of the cylindrical walls 7, 8 and 14, 15, which form is advantageous to the desired dispersion effect, the slots are preferably formed as axial bores in the walls from the free end edges thereof and have a diameter exceeding the wall thickness and a depth of bore which may, for example, be as shown by the dashed lines 21 and 22 in FIG. 1.

As a result of the wall geometry, the radially outermost wall on the rotor disc 5 will rotate in the injection chamber 13 formed between the stator walls 14 and 15, while the radially innermost wall 7 on the rotor disc 5 rotates on the inside of the radially innermost stator wall 14 and together with it ensures good distribution of the product supplied through the feed pipe 10, before the product is passed into the chamber 13. The radially innermost rotor wall 7 is not, however, strictly necessary.

The rotary velocity for the rotor disc 5 may vary from 100 to some 1000 rpm depending on the current purpose of application.

The second fluid supplied is forced through the slots 19 in the rotor and stator walls 7, 14, 8 and 15 during the rotation and finishes by being passed out through the outlet 11.

The steam, gas or liquid supply through the feed pipe 18, the distributor pipe 17 and the channels 16 is injected into the second fluid in the injection chamber 13 between the stationary chamber walls 14 and 15, and owing to the radial displacement effect and the tangential comminuting or dispersion effect deriving from the sharp-edged slots, an instantaneous entrainment of the injected fluid is obtained so that by heat treatment, for example, an almost instantaneous temperature increase is obtained without burning, which is mainly due to the wall geometry with the little clearance between the walls 7, 8, 14 and 15 and the slots 19 therein.

As a further explanation of the invention, some non-restricting examples carried out in practice are given below.

The following examples were carried out using the above embodiment of the apparatus according to the invention, in all cases with a rotary velocity of 2800 rpm.

EXAMPLE 1

A skimmed milk concentrate with a dry solids content of 50 per cent by weight and a viscosity of 76 cP was heat treated by injection of steam at a vapor pressure of 4.6 bar from an initial temperature of 40° C. to a sterilization temperature of 143° C. The concentrate was then cooled in a conventional manner in an evaporative cooler. As a result of the heat treatment, the desired sterilization was obtained with a mortal effect on spore-forming bacteria and their spores. This result was obtained without any kind of burning, discoloration or other destruction of functional properties in the product. Thus the deterioration of taste was insignificant compared to the starting material.

EXAMPLE 2

A whole milk concentrate with a dry solids content of 45 per cent by weight and a viscosity of 82 cP was heated by steam injection at a vapor pressure of 5.4 bar from an initial temperature of 10° C. to 145° C. with the same good results as stated in Example 1.

EXAMPLE 3

A skimmed milk concentrate with a dry solids content of 43 per cent by weight and a viscosity of 75 cP was heated by steam injection at a vapor pressure of 4.3 bar from a temperature of 15° C. to a sterilization temperature of 143° C. Also in this case, the same good results of the heat treatment were obtained as stated in Example 1.

Tests have shown that correspondingly good results as those obtained in the above examples 1–3 may be obtained, even when the steam is superheated by up to 20° C.

EXAMPLE 4

After preheating to a temperature of 60° C., a skimmed milk concentrate intended for use as starting material for spray drying, having a dry solids content of 48 per cent by weight and a viscosity of 76 cP, had $CO_2$ added to it with a view to obtaining a spray-dried powder of reduced density by injection of $CO_2$ in an amount of 3 g/kg and at a pressure of 4 bar. This treatment and the subsequent spray drying yielded a powder of a density of 0.324 g/cm$^3$.

EXAMPLE 5

To a skimmed milk concentrate with a dry solids content of 48 percent by weight and a viscosity of 76 cP, was added $CO_2$ by injection in an amount of 1.5 g/kg and at a temperature of 75° C. and a pressure of 4 bar. The subsequent spray drying yielded a powder of a density of 0.308 g/cm$^3$.

EXAMPLE 6

To a skimmed milk concentrate with a dry solid content of 45 per cent by weight and a viscosity of 76 cP, was added $CO_2$ by injection in an amount of 1.2 g/kg and at a temperature of 85° C. and a pressure of 4 bar. The subsequent spray drying yielded a powder of a density of 0.347 g/cm$^3$.

These examples only to a limited extend illustrate the application potential for the method and the apparatus according to the invention, but confirm the good results obtained both by steam injection and by injection of a gas for the purpose of reducing the density of a powder obtained by subsequent spray drying.

With regard to the application potential in general, the method and the apparatus according to the invention as mentioned above, are suitable for fluid products with a dry solids content ranging from 0 to 90 per cent by weight both in connection with steam injection and by injection of a cold gas. The viscosity may also vary within a wide range from 0.1 to 100,000 cP.

Also with regard to products, the method and the apparatus according to the invention have numerous capabilities within the treatment of food products, such as heat treatment, density-reducing gas injection, gelatinizing, and emulgation, and for technical products, such as plastic materials to be foamed.

I claim:

1. A method of injecting a first fluid into a second fluid by means of an injection apparatus having a casing including a stator part (9), a substantially disc-shaped rotor (5) positioned opposite said stator part in parallel and coaxial relationship thereto, a central product inlet, a peripheral product outlet, and an annular injection zone (13) above said disc-shaped rotor (5) and located between, but displaced from both said inlet (10) and said outlet (11), comprising the steps of; imparting to said second fluid a radial displacement effect from said product inlet (10) to said product outlet (11), injecting said first fluid into said zone, and exposing said second fluid in said zone to a tangential dispersion effect in addition to said radial displacement effect, by forcing the second fluid through sharp-edged slots (19) extending substantially parallel to the rotor axis in opposed coaxial cylindrical wall parts (7, 14, 15) of said rotor (5) and said stator part (9).

2. A method according to claim 1, wherein the second fluid is a liquid with a dry solids content ranging between 0 and 90 percent.

3. A method according to claim 2 wherein, the second fluid is a milk concentrate.

4. A method according to claim 2, wherein the second fluid is a starch product intended for gelatinization.

5. A method according to claim 1, wherein the first fluid is steam which is injected at a temperature in the range of 100°–200° C. and a vapor pressure in the range of 1.5–12 bar for instantaneous heating of the second fluid.

6. A method according to claim 5, wherein the steam is injected at a temperature in the range of 120°–165° C. and a vapor pressure in the range of 2–6 bar.

7. A method according to claim 1, wherein the first fluid is a gas injected for reduction of the density of the second fluid or a product obtained by spray drying thereof.

8. A method according to claim 1, wherein the first fluid is a liquid injected for emulsification of or into the second fluid.

9. An apparatus for injecting a first fluid into a second fluid comprising; a casing (12) including a stator part (9), a substantially disc-shaped rotor (5) positioned opposite said stator part in parallel and coaxial relationship thereto, a central product inlet (10) for said second fluid and a peripheral product outlet (11), said rotor being provided on the side facing said stator part (9) with at least one projecting cylindrical wall (7, 8) and said stator part being provided on the side facing the rotor (5) with at least two projecting coaxial cylindrical walls (14, 15) disposed on either side of the cylindrical wall on the rotor (5), sharp-edged slots (19) formed to extend substantially parallel to the axis of the rotor in said coaxial cylindrical walls (7, 8, 14, 15) on said rotor (5) and said stator part (9), and feed passages (16') being formed in said stator part (9) for injection of said first fluid into an injection zone (13) between the coaxial cylindrical walls (14, 15) on said stator part (9).

10. An apparatus according to claim 9, wherein the rotor (5) has two projecting coaxial cylindrical walls (7, 8), of which the radially innermost wall (7) is located radially inside the radially innermost wall (14) on said stator part.

11. An apparatus according to claim 9, wherein the projecting coaxial cylindrical walls (7, 8, 14, 15) on said rotor (5) and said stator part.

12. An apparatus according to claim 9, wherein said slots (19) in the cylindrical walls (7, 8, 14, 15) are formed as axially directed bores from the free edges of these walls and having a diameter exceeding the wall thickness.

13. An apparatus according to claim 9, wherein the slots (19) in the cylindrical walls (7, 8, 14, 15) are distributed asymmetrically in the circumferential direction.

14. An apparatus according to claim 9, wherein the feed passages for the first fluid comprises a number of tubular channels (16), opening out into said injection chamber (13) at substantially mutually equidistant positions.

* * * * *